US006364501B1

(12) United States Patent
Tai

(10) Patent No.: US 6,364,501 B1
(45) Date of Patent: Apr. 2, 2002

(54) ILLUMINATIVE VASE-TYPE SCENTED ORNAMENTAL DECORATION STRUCTURE

(76) Inventor: Hung-Te Tai, No. 12, 244 Lane, Dong-Far Road, Ho-Mei Chen, Chang-Hua Hsien (TW)

( * ) Notice: Subject to any disclaimer, the term of this patent is extended or adjusted under 35 U.S.C. 154(b) by 0 days.

(21) Appl. No.: 09/453,064

(22) Filed: Dec. 2, 1999

(51) Int. Cl.[7] ..... A41G 1/00
(52) U.S. Cl. ..... 362/122; 428/24; 362/800; 362/806
(58) Field of Search ..... 428/24, 26, 905; 362/122, 800, 806

*Primary Examiner*—Alexander S. Thomas
(74) *Attorney, Agent, or Firm*—Bacon & Thomas

(57) ABSTRACT

An illuminative vase-type scented ornamental decoration structure capable of providing illumination from the middle of the bottom section of the ornamental decoration and comprised of a translucent vase-type decorative ornament having a fastening section at the bottom end with internal threads tapped along the interior sides, a receptacle fastened onto the lower extent of the ornamental decoration, and a stem inserted in the bottom end of the receptacle. The innovative features are that the vase-type decorative ornament has a plug with a hollow recess formed in the center that is fitted into the fastening section. A light emitting diode (LED) is positioned in the center of the receptacle and, furthermore, the bottom end of the LED extends to a circuit control board disposed on the exterior side of the receptacle. After the receptacle is fastened to the vase-type decorative ornament, the LED is installed into the hollow recess of the plug. Due to the creatively designed covering around the receptacle, the illumination of the LED is focused upward to achieve translucence, with the light refracted through the variegated linear contours of the vase-type decorative ornament. As such, the present invention serves as an effective replacement for a lampstand or evening light and, furthermore, the illuminative vase-type scented ornamental decoration of the invention herein is capable of enhancing the ambience of interior atmospheres.

6 Claims, 6 Drawing Sheets

ILLUMINATIVE VASE-TYPE SCENTED ORNAMENTAL DECORATION STRUCTURE

BACKGROUND OF THE INVENTION

1) Field of the Invention

The invention herein relates to an illuminative vase-type scented ornamental decoration structure in which the vase-type decorative ornament has a plug with a hollow recess formed in the center that is fitted into a fastening section, a light emitting diode (LED) is positioned in the center of the receptacle and, furthermore, the bottom end of the LED extends to a circuit control board disposed on the exterior side of the receptacle; after the receptacle is fastened to the vase-type decorative ornament, the said LED is installed into the hollow recess of the plug and, furthermore, due to the creatively designed covering around the receptacle, the illumination of the LED is focused upward to achieve translucence, with the light refracted through the variegated linear contours of the vase-type decorative ornament; as such, the present invention also serves as an effective replacement for a lampstand or small evening light and, furthermore, the vase-type scented ornamental decoration of the invention herein is capable of enhancing the ambience of interior atmospheres.

2) Description of the Prior Art

Since roses inspire feelings of romance in most people, these flowers are often displayed on counters and tables in many restaurants and, furthermore, are usually placed next to a lampstand or small evening light to create a romantic atmosphere in dining areas. In western restaurants, since two patrons are seated at a single small table, the placement of both a lampstand and a rose greatly decreases the amount of usable space, occupying the table surface such that it inconveniences the dining consumers.

As for replacement flower-type decorations of aesthetic appearance now available, a type in current fashion is a miniature flower and vase scented ornamental decoration structure comprised of a vase-type ornamental decoration, a receptacle fastened to the lower extent of the vase-type ornamental decoration, and a stem inserted into the bottom end of the receptacle; however, since such conventional vase-type scented ornamental decoration lack an illumination function, they can only serve as decorative air fresheners and although the said vase-type scented ornamental decoration can be utilized for enhancing indoor environments, it cannot replace a lampstand or small evening light, or create a romantic atmosphere because of insufficient aesthetic qualities; in view of the said situation, the inventor of the invention herein conducted extensive research, testing, and refinement that culminated in the successful development of the illuminative vase-type scented ornamental decoration structure of the present invention, which completely eliminates the various shortcomings of the conventional products and, furthermore, provides significantly greater practical functionality.

SUMMARY OF THE INVENTION

The primary objective of the invention herein is to provide an illuminative vase-type scented ornamental decoration structure comprised of a translucent vase-type decorative ornament having a fastening section at the bottom end with internal threads tapped along the interior sides, a receptacle fastened onto the lower extent of the ornamental decoration, and a stem inserted in the bottom end of the receptacle; the vase-type decorative ornament has a plug with a hollow recess formed in the center that is fitted into the fastening section; a light emitting diode (LED) is positioned in the center of the receptacle and, furthermore, the bottom end of the LED extends to a circuit control board disposed on the exterior side of the receptacle; after the receptacle is fastened to the vase-type decorative ornament, the LED is installed into the hollow recess of the plug; due to the creatively designed covering around the receptacle, the illumination of the LED is focused upward to achieve translucence, with the light refracted through the variegated linear contours of the vase-type decorative ornament; as such, the present invention serves as an effective replacement for a lampstand or night light and, furthermore, the vase-type scented ornamental decoration of the invention herein is capable of enhancing interior atmospheres.

To enable the examination committee to further understand the structure, innovative features, functions, and practical objectives of the invention herein, the brief description of the drawings below is followed by the detail description of the preferred embodiments.

DETAILED DESCRIPTION OF THE PREFERRED EMBODIMENTS

Figure 1:
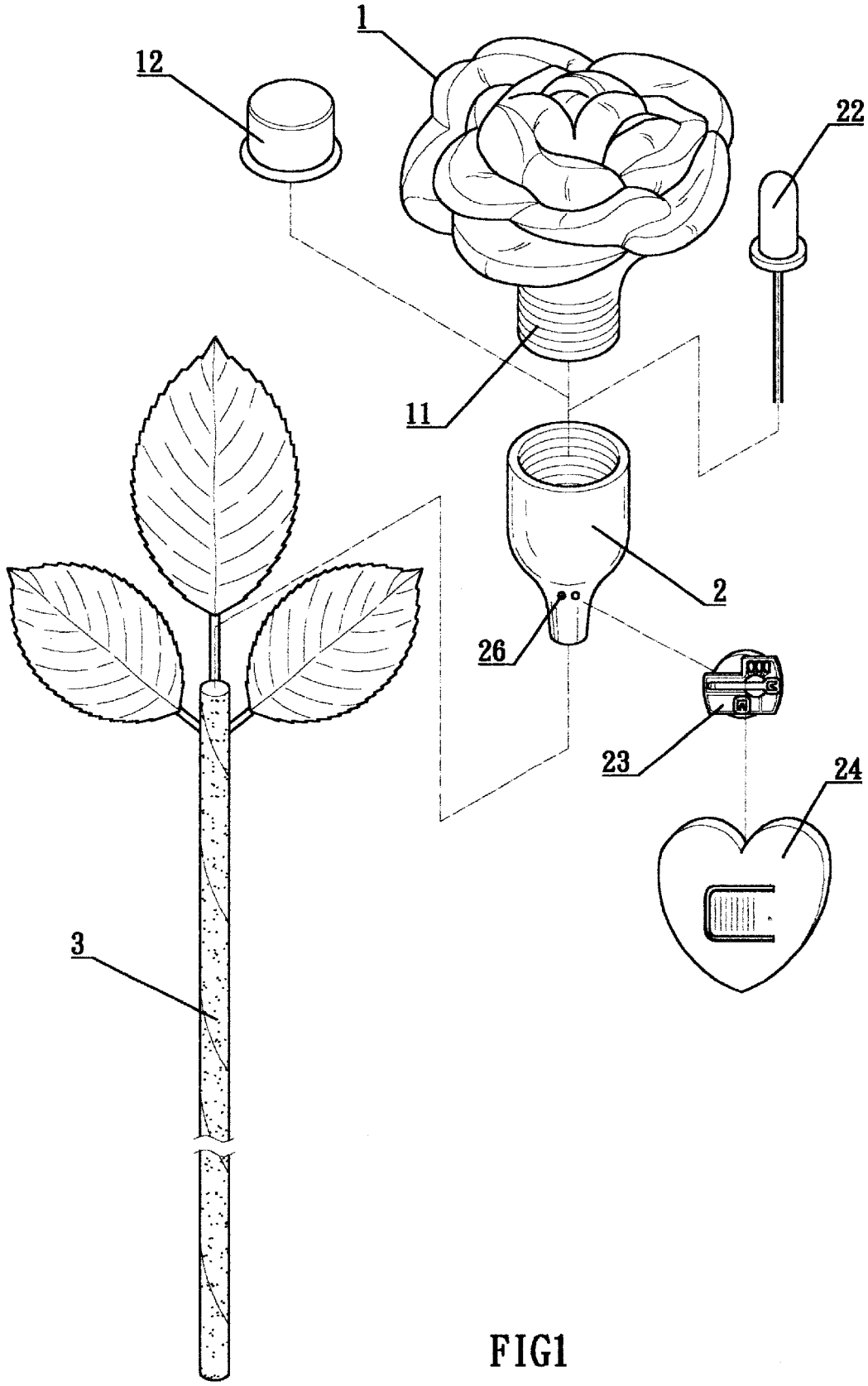
FIG. 1 is an exploded drawing of the invention herein.
Figure 2:
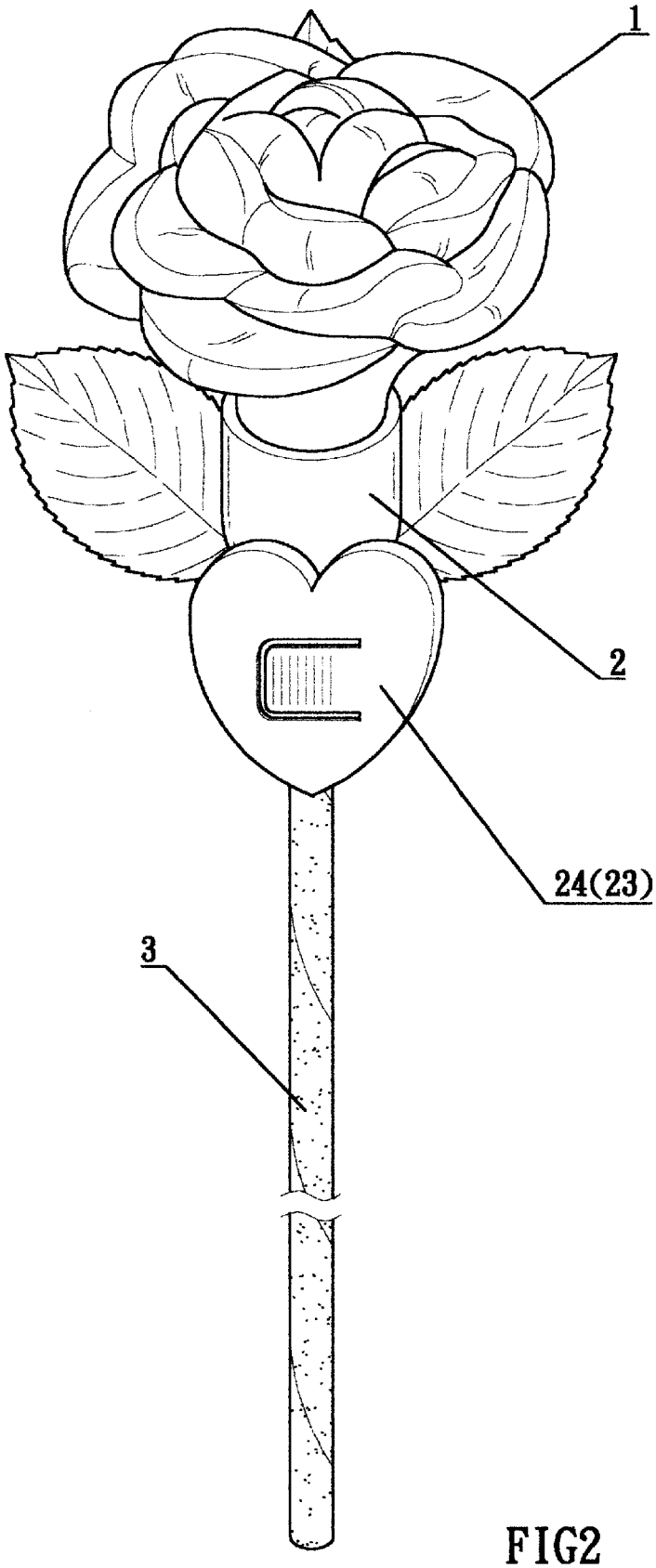
FIG. 2 is an isometric drawing of the invention herein.

Referring to FIG. 1 and FIG. 2, the invention herein is comprised of a vase-type ornamental decoration 1 with internal threads 21 tapped along the interior sides, a receptacle 2 fastened onto the lower extent of the ornamental decoration 1, and a stem 3 inserted in the bottom end of the receptacle 2.

Of which, the said ornamental decoration 1 has an externally threaded fastening section 11 disposed at its bottom end and, furthermore, fitted into the fastening section 11 is a plug 12 having a hollow recess 121 formed in the center.

A light emitting diode (LED) 22 is positioned inside the center of the receptacle 2 and, furthermore, a through-hole 26 is formed in the outer side to provide for routing the wiring from the bottom end of the LED 22 and to enable the circuit control board 23 to extend form the exterior side of the ornamental decoration 1 and, furthermore, a light bulb or other illuminating component can be utilized in place of the said LED 22; the circuit control board 23 is enclosed in a protective outer housing 24 and, furthermore, the circuit control board 23 has a built-in battery such that after the user squeezes the outer housing 24, the resulting contact switches the power source of the circuit control board 23 either ON or OFF.

Following the attachment of the receptacle 2 to the ornamental decoration 1, the said LED 22 is installed into the hollow recess 121 and after the user switches ON the circuit control board 23, the LED 22 illuminates and, furthermore, due to the innovative covering around the receptacle 2, the illumination of the LED 22 is focused upward but is not radiated outward, with the light refracted through the variegated linear contours of the vase-type decorative ornament 1 and as such, serves as an effective replacement for a lampstand or evening light and, furthermore, the vase-type scented ornamental decoration of the invention herein is capable of enhancing interior atmospheres.

Figure 3:
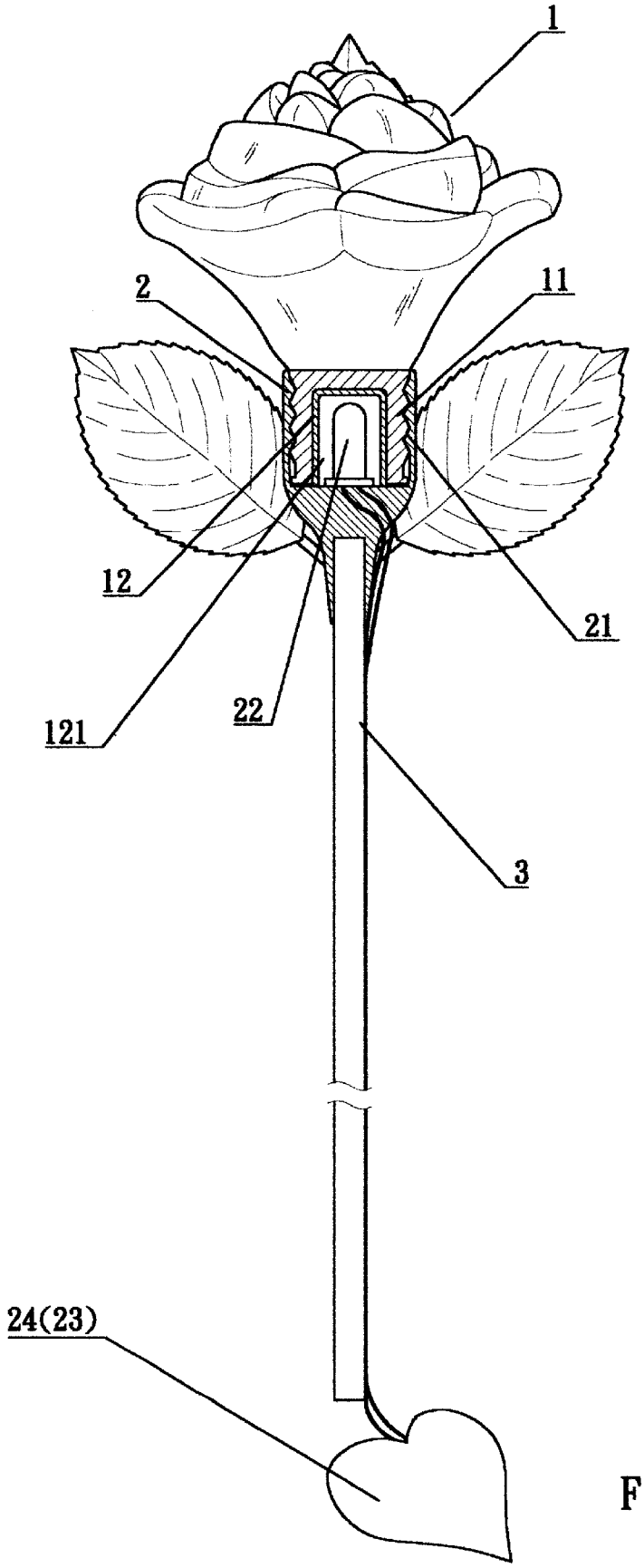
FIG. 3 is an orthographic drawing of the second embodiment of the invention herein.

Referring to FIG. 3, FIG. 4, FIG. 5, and FIG. 6, the four embodiments of the invention herein features different circuit control board installation arrangements, of which:

In the first structure, the wiring at the bottom end of the LED 22 is inserted into the through-hole 26 of the receptacle 2 and routed along the stem 3 to the circuit control board 23 situated at the lower exterior (as shown in FIG. 3).

Figure 4:
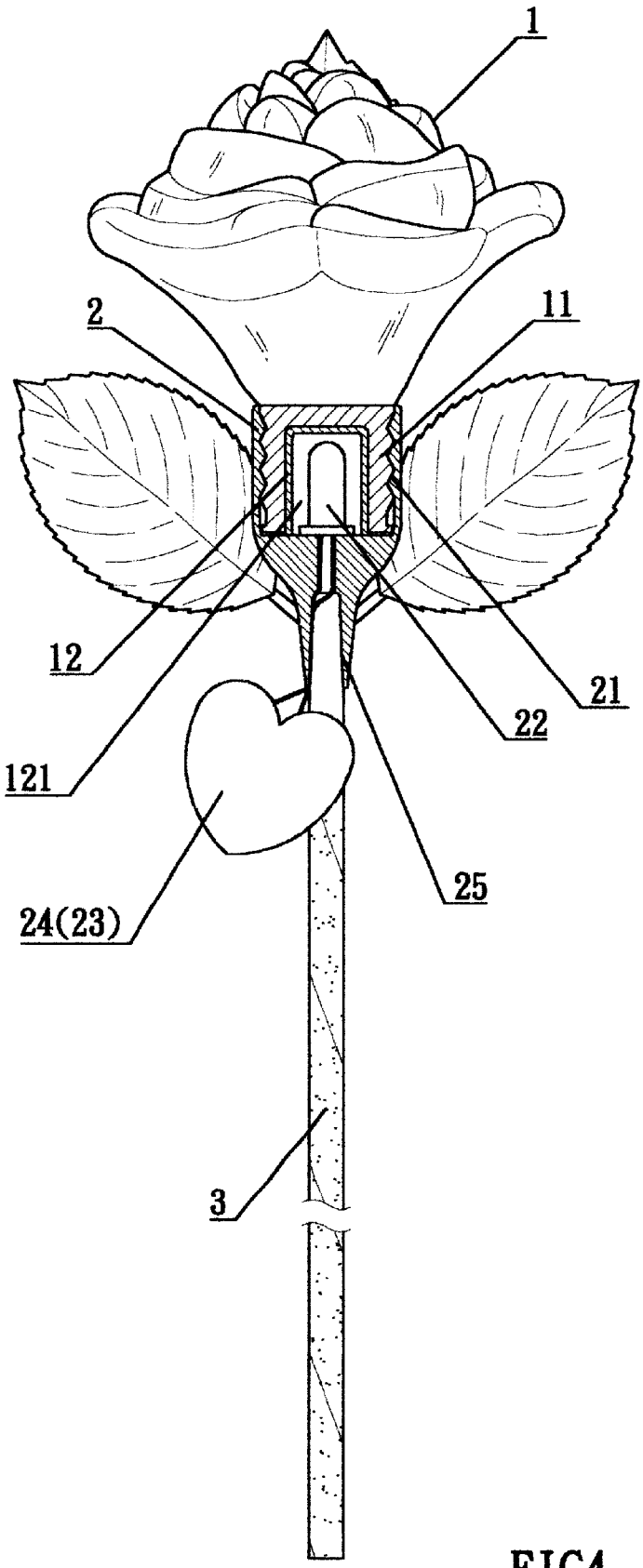
FIG. 4 is an orthographic drawing of the third embodiment of the invention herein.

In the second structure, the circuit control board 23 extends from the bottom end of the LED 22 positioned in the inner annular surface of the receptacle 2.(as shown in FIG. 4).

Figure 5:
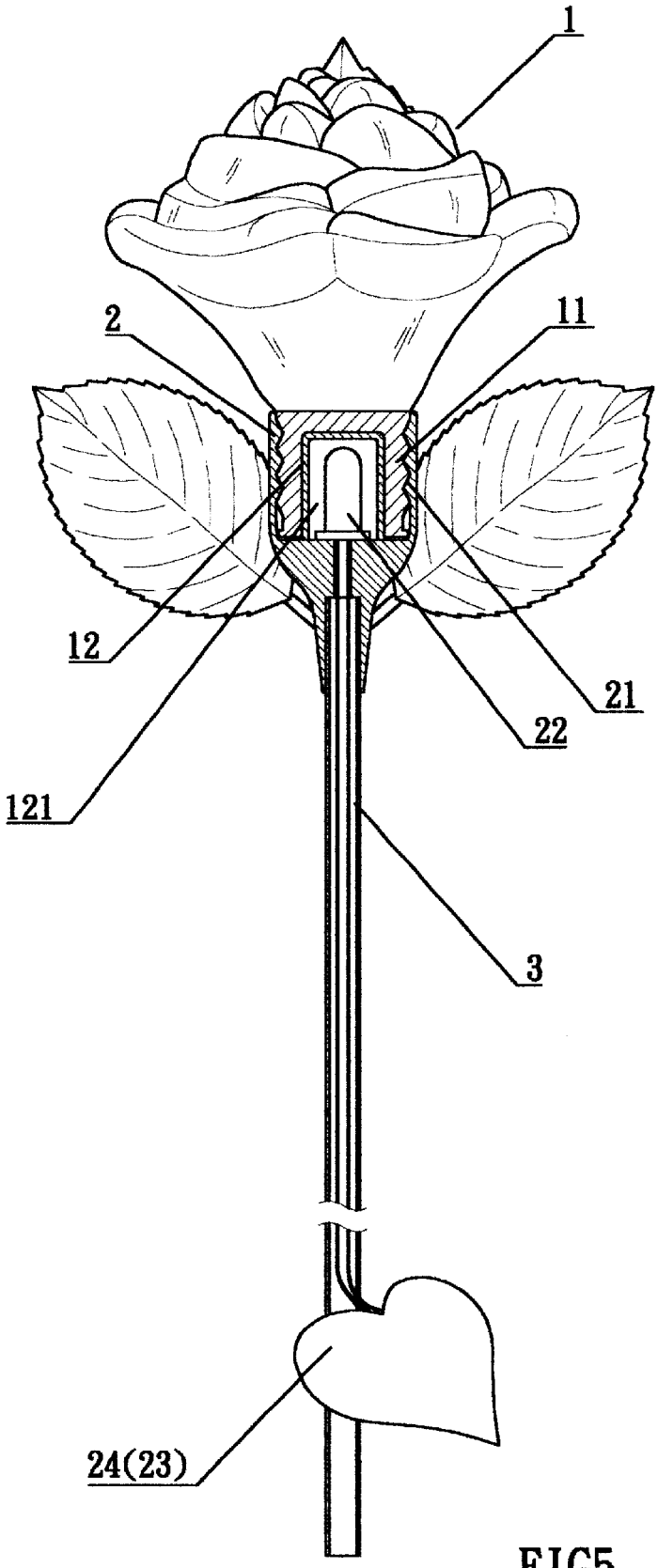
FIG. 5 is an orthographic drawing of the fourth embodiment of the invention herein.

In the third structure, the stem 3 is designed as a hollow tubular construct to enable the circuit control board 23 to extend from the LED 22 inside the receptacle 2 and out through bottom end of the stem 3 (as shown in FIG. 5).

Figure 6:
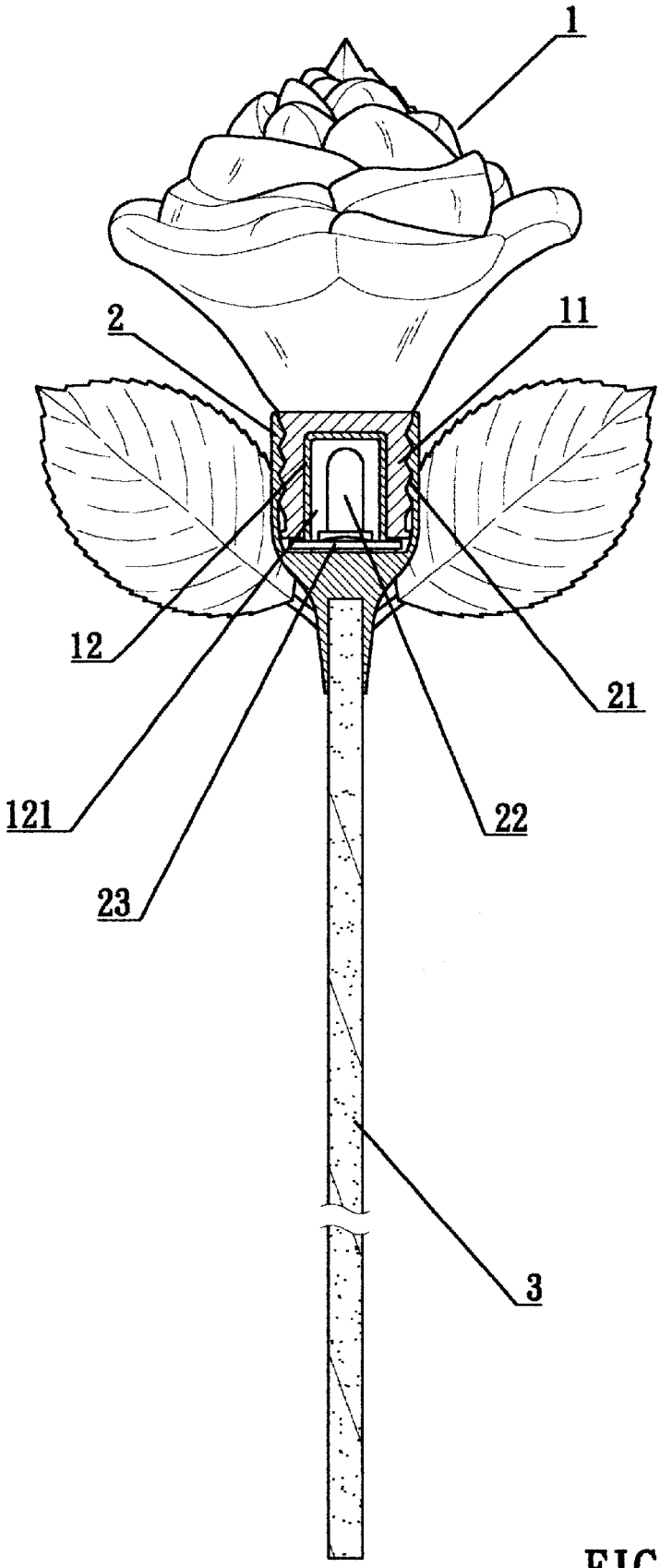
FIG. 6 is an orthographic drawing of the fifth embodiment of the invention herein.

In the fourth structure, the circuit control board 23 is directly concealed inside the receptacle 2 such that the circuit control board 23 is not exposed outside of the vase-type ornamental decoration 1 (as shown in FIG. 6).

In summation of the foregoing section, since the illuminative vase-type scented ornamental decoration structure of the invention herein is of an innovative structure and capable of achieving its original objectives and, furthermore, provides significantly greater practical functionality than the conventional products, the invention herein fully complies with new patent application requirements and is lawfully submitted for review and the granting of the commensurate patents pursuant to encouraging the spirit of invention as defined by the patent law.

What is claimed is:

1. An illuminative vase ornamental decoration structure comprising a translucent vase decorative ornament having a fastening section at a bottom end with internal threads tapped along its interior sides, a receptacle fastened onto a lower extent of the ornamental decoration, and a stem inserted in a bottom end of the receptacle, the vase decorative ornament has a plug with a hollow recess formed in the center and the plug is fitted into the fastening section; a light emitting diode (LED) is positioned in the center of the receptacle, a bottom end of the LED extends to a circuit control board disposed on an exterior side of the receptacle, the receptacle is fastened to the vase decorative ornament, the LED is installed in the hollow recess of the plug. and the illumination of the LED is focused upward to achieve translucence, with the light being refracted through variegated linear contours of the vase decorative ornament for enhancing interior atmospheres.

2. The illuminative vase scented ornamental decoration structure of claim 1, wherein the bottom end of the LED positioned in the receptacle is extended to the exterior side of the receptacle and along the stem to the circuit control board situated at a lower exterior aspect of the stem.

3. The illuminative vase scented ornamental decoration structure of claim 1, wherein the LED positioned in an inner annular surface of the receptacle extends to the circuit control board.

4. The illuminative vase scented ornamental decoration structure of claim 1, wherein the stem is of a hollow tubular form and the bottom end of the LED inside the receptacle is routed through the hollow section of the stem to the circuit control board.

5. The illuminative vase scented ornamental decoration structure of claim 1, wherein the circuit control board is concealed inside the receptacle such that the circuit control board is not exposed to the exterior of the vase ornamental decoration.

6. An illuminative vase scented ornamental decoration structure comprising a translucent vase decorative ornament having a fastening section at a bottom end with internal threads tapped along its interior sides, a receptacle fastened onto a lower extent of the ornamental decoration, and a stem inserted in a bottom end of the receptacle, the vase decorative ornament has a plug with a hollow recess formed in the center and the plug is fitted into the fastening section, an illuminating means is positioned in the center of the receptacle, a bottom end of the illuminating means extends to a circuit control board disposed on an exterior side of the receptacle, the receptacle is fastened to the vase decorative ornament, the illuminating means is installed in the hollow recess of the plug, and the illumination of the illuminating means is focused upward to achieve translucence, with the light being refracted through variegated linear contours of the vase decorative ornament for enhancing interior atmospheres.

* * * * *